US010096961B2

(12) United States Patent
Zhao

(10) Patent No.: US 10,096,961 B2
(45) Date of Patent: Oct. 9, 2018

(54) ELECTRICAL CONNECTOR HAVING UPPER AND LOWER POWER CONTACTS IN CONTACT WITH METALLIC PLATE AND MAKING METHOD THEREOF

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/860,634

(22) Filed: Jan. 2, 2018

(65) Prior Publication Data

US 2018/0191119 A1 Jul. 5, 2018

(30) Foreign Application Priority Data

Dec. 30, 2016 (CN) ..... 2016 1 1262570

(51) Int. Cl.

| | |
|---|---|
| ***H01R 13/6585*** | (2011.01) |
| ***H01R 43/18*** | (2006.01) |
| ***H01R 24/60*** | (2011.01) |
| *H01R 107/00* | (2006.01) |

(52) U.S. Cl.

CPC ..... *H01R 43/18* (2013.01); *H01R 13/6585* (2013.01); *H01R 24/60* (2013.01); *H01R 2107/00* (2013.01)

(58) Field of Classification Search

CPC .... H01R 13/6585; H01R 24/60; H01R 43/18; H01R 2107/00; H01R 13/5208; H01R 13/5202; H01R 13/5216; H01R 13/5219; H01R 13/6587; H01R 12/724

USPC ..... 439/607.11, 607.05, 607.06, 607.07, 439/607.09, 660, 587, 607.35, 607.36, 439/607.13

See application file for complete search history.

(56) References Cited

U.S. PATENT DOCUMENTS

| | | | | |
|---|---|---|---|---|
| 7,670,156 | B2 * | 3/2010 | Chen | H01R 13/6485 439/108 |
| 7,758,379 | B2 * | 7/2010 | Chen | H01R 13/6485 439/607.11 |
| 8,851,927 | B2 * | 10/2014 | Hsu | H01R 12/724 439/607.11 |
| 9,379,494 | B1 * | 6/2016 | Hu | H01R 13/6594 |
| 9,525,244 | B1 * | 12/2016 | Hsu | H01R 13/6585 |

(Continued)

FOREIGN PATENT DOCUMENTS

| | | |
|---|---|---|
| CN | 204118317 U | 1/2015 |
| CN | 104810657 A | 7/2015 |

(Continued)

*Primary Examiner* — Harshad C Patel

(74) *Attorney, Agent, or Firm* — Wei Te Chung; Ming Chieh Chang

(57) ABSTRACT

A method of making an electrical connector comprises the steps of: insert molding a first insulator with an upper and lower rows of contacts and a metallic element arranged between the upper row of contacts and the lower row of contacts while leaving a void space to expose a bridge of the metallic element; cutting the bridge of the metallic element through the void space to form a first plate and a second plate separated from each other; and insert molding a second insulator to fill up the void space.

2 Claims, 13 Drawing Sheets

(56) References Cited

U.S. PATENT DOCUMENTS

| | | | | |
|---|---|---|---|---|
| 2013/0316581 | A1* | 11/2013 | Kao | H01R 13/6471 439/607.28 |
| 2015/0244111 | A1* | 8/2015 | Ju | H01R 13/6585 439/607.05 |
| 2015/0244118 | A1* | 8/2015 | Lin | H01R 24/60 439/357 |
| 2016/0099526 | A1* | 4/2016 | Chen | H01R 13/5045 439/607.05 |
| 2016/0233630 | A1* | 8/2016 | Cheng | H01R 24/60 |
| 2016/0359274 | A1 | 12/2016 | Zhang et al. | |

FOREIGN PATENT DOCUMENTS

| | | | |
|---|---|---|---|
| CN | 105024197 | A | 11/2015 |
| CN | 105552618 | A | 5/2016 |
| CN | 205190740 | U | 12/2016 |

* cited by examiner

ELECTRICAL CONNECTOR HAVING UPPER AND LOWER POWER CONTACTS IN CONTACT WITH METALLIC PLATE AND MAKING METHOD THEREOF

BACKGROUND OF THE INVENTION

1. Field of the Invention

The present invention relates to a method of making an electrical connector having an upper ground contact in an upper row of contacts and a lower ground contact in a lower row of contacts that are respectively in contact with two opposite faces of a first metallic plate and an upper power contact in the upper row and a lower power contact in the lower row that are respectively in contact with two opposite faces of a second metallic plate.

2. Description of Related Arts

It is known for Universal Serial Bus (USB) Type-C connectors to have ground contacts in an upper and lower rows of contacts in contact with a first middle metallic plate and power contacts in the upper and lower rows in contact with a second middle metallic plate, wherein the first middle metallic plate and the second middle metallic plate are formed separately.

SUMMARY OF THE INVENTION

A method of making an electrical connector comprises the steps of: insert molding a first insulator with an upper and lower rows of contacts and a metallic element arranged between the upper row of contacts and the lower row of contacts while leaving a void space to expose a bridge of the metallic element; cutting the bridge of the metallic element through the void space to form a first plate and a second plate separated from each other; and insert molding a second insulator to fill up the void space.

DETAILED DESCRIPTION OF THE PREFERRED EMBODIMENT

Figure 1:
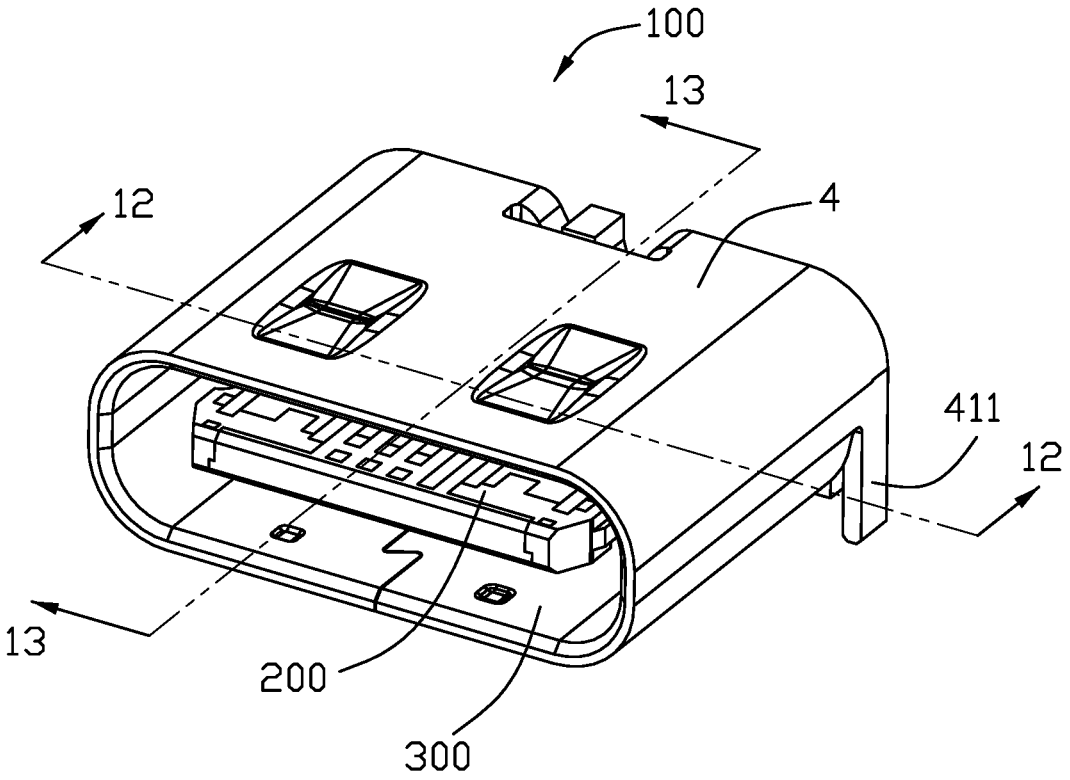
FIG. 1 is a perspective view of an electrical connector in accordance with the present invention.
Figure 2:
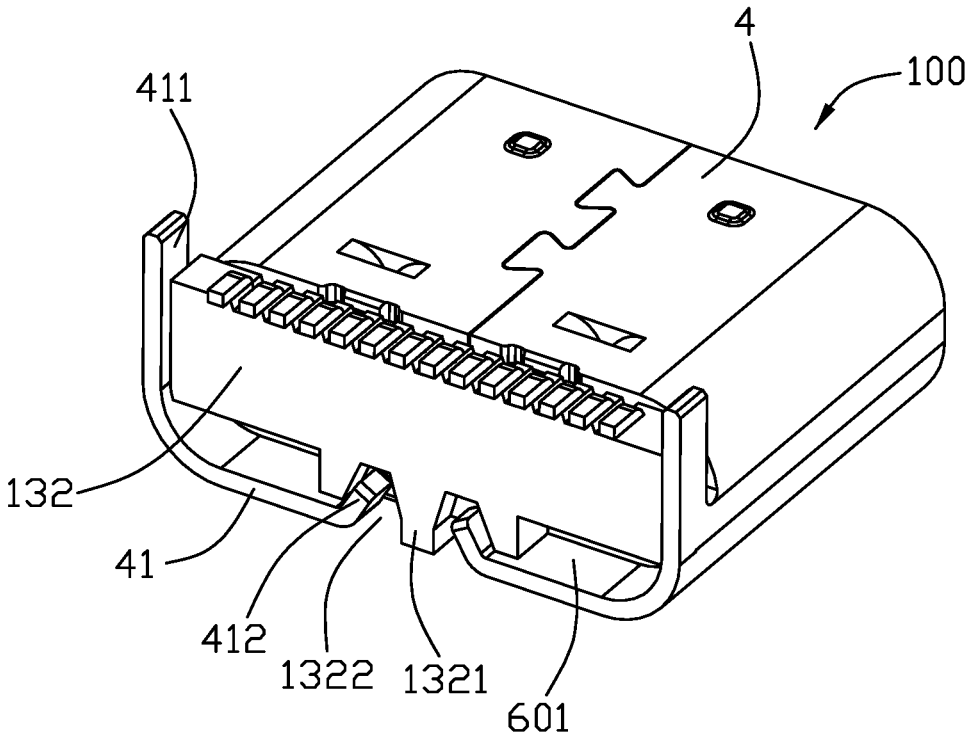
FIG. 2 is another perspective view of the electrical connector.

Referring to FIGS. 1-11, an electrical connector 100 comprises a contact module 200 and a shielding shell 4 enclosing the contact module 200. The electrical connector 100 may further comprise a rear sealing element 5. The contact module 200 includes an insulative housing 1, two rows of contacts 2 including the upper contacts and the lower contacts and arranged in the insulative housing 1, and a metallic element 3 arranged in the insulative housing 1 between the two rows of contacts 2.

Referring specifically to FIGS. 5-11, the insulative housing 1 includes a base 11 and a tongue 12. The insulative housing 1 is constructed of a first insulator 13 that is insert molded with the contacts 2 and a second insulator 14 that is further over-molding the insert-molded first body and contacts. The first insulator 13 has a base part 130 and a tongue part 133. The base part 130 has a front portion 131, a rear portion 132, and a gap 134 dividing the front and rear portions. There are three blocks 1321 at the rear portion 132 and two slots 1322 between the blocks 1321. The tongue portion 133 has a void space 1331. The second insulator 14 fills up the void space 1331. The tongue part 133 and the second insulator 14 constitute the tongue 12 of the insulative housing 1. The base part 130 of the first insulator 13 constitutes the base 11 of the insulative housing 1.

Figure 3:
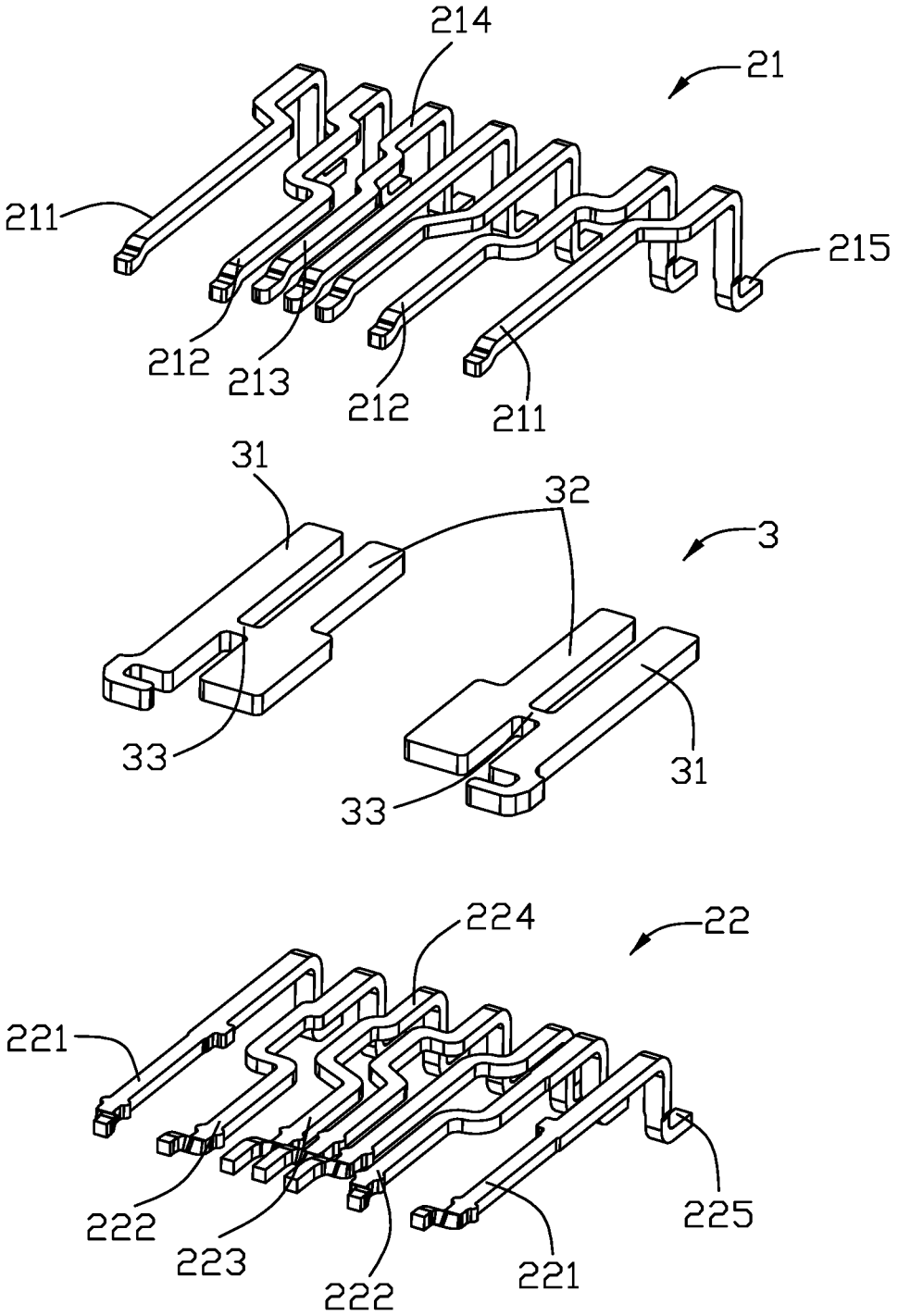
FIG. 3 is a schematic exploded view of two rows of contacts and a metallic element of the electrical connector.
Figure 4:
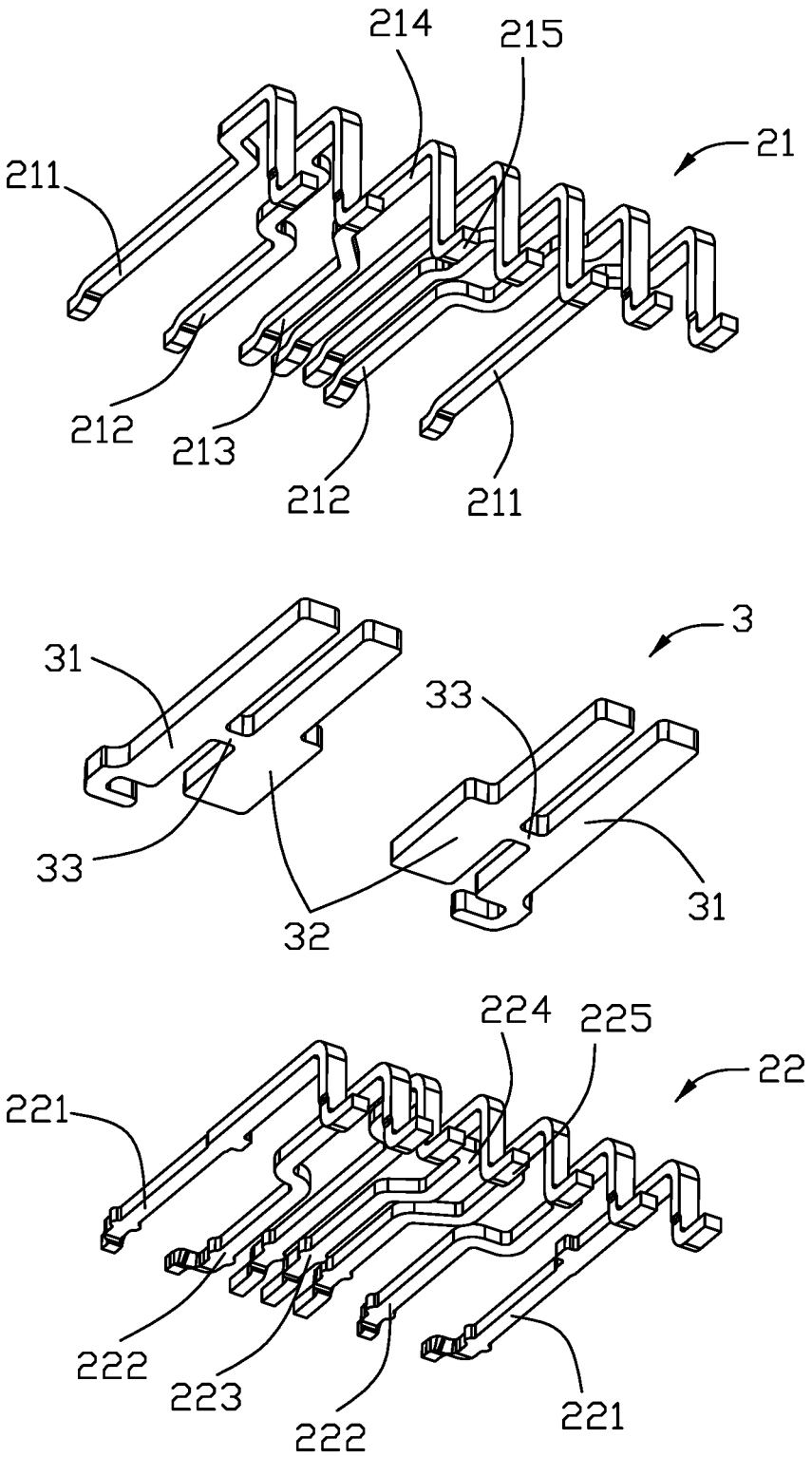
FIG. 4 is a view similar to FIG. 3 but from a different perspective.
Figure 5:
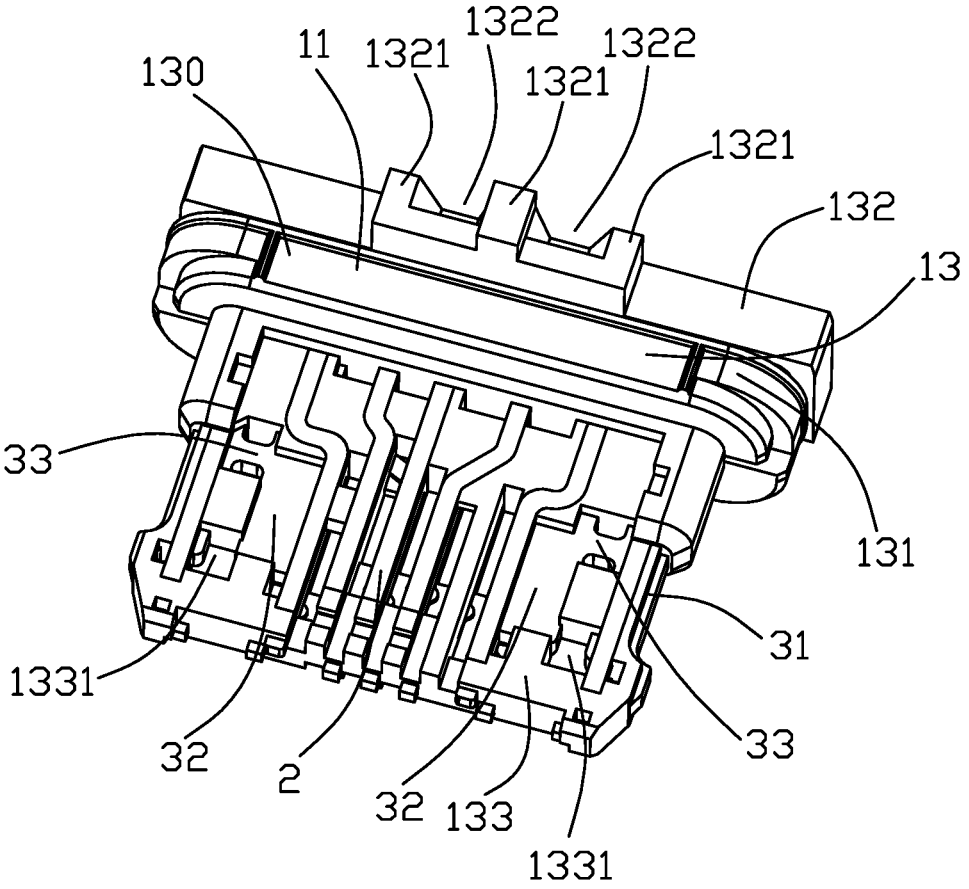
FIG. 5 is an assembled perspective view of the contacts and the metallic element with an insulator.
Figure 6:
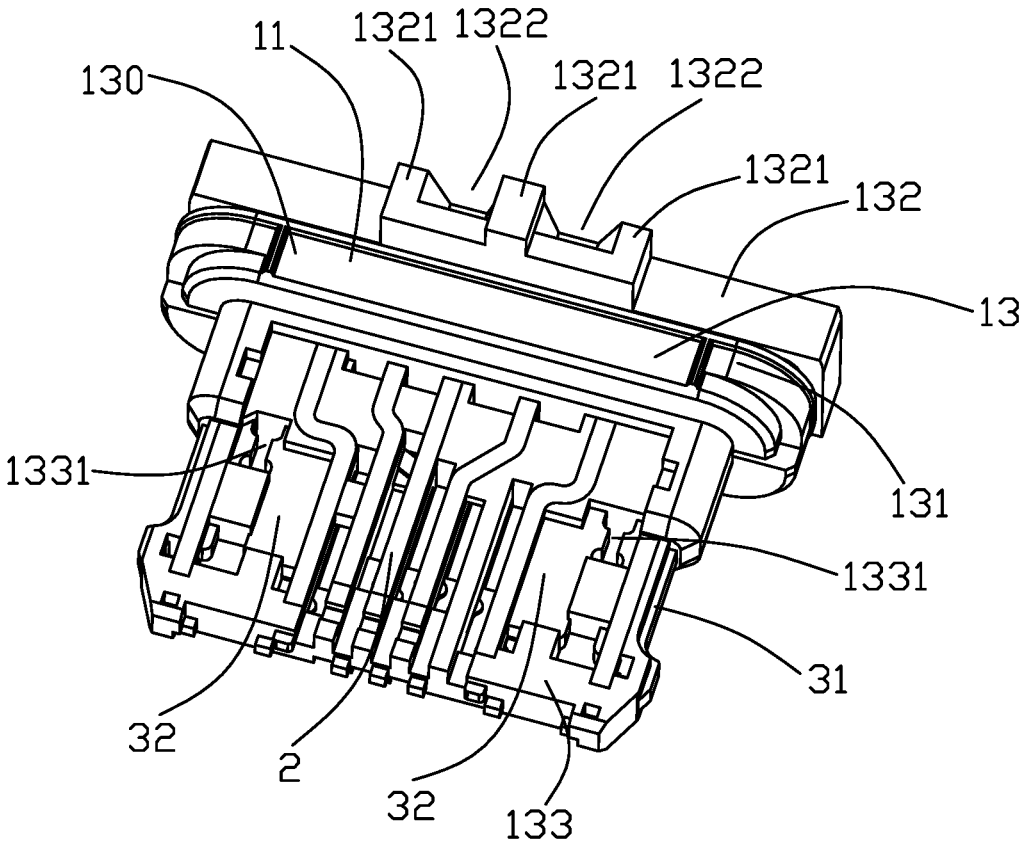
FIG. 6 is a view similar to FIG. 5 but showing a bridge of the metallic element is cut.
Figure 7:
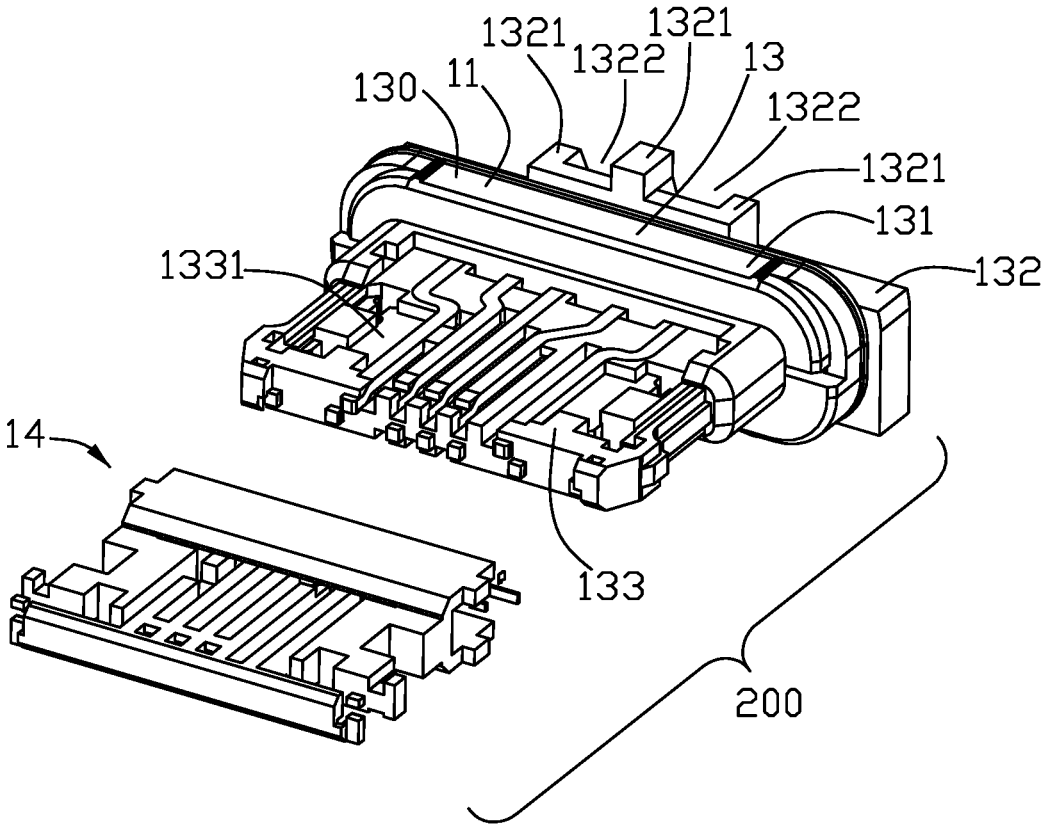
FIG. 7 is an exploded view of a contact module of the electrical connector.
Figure 8:
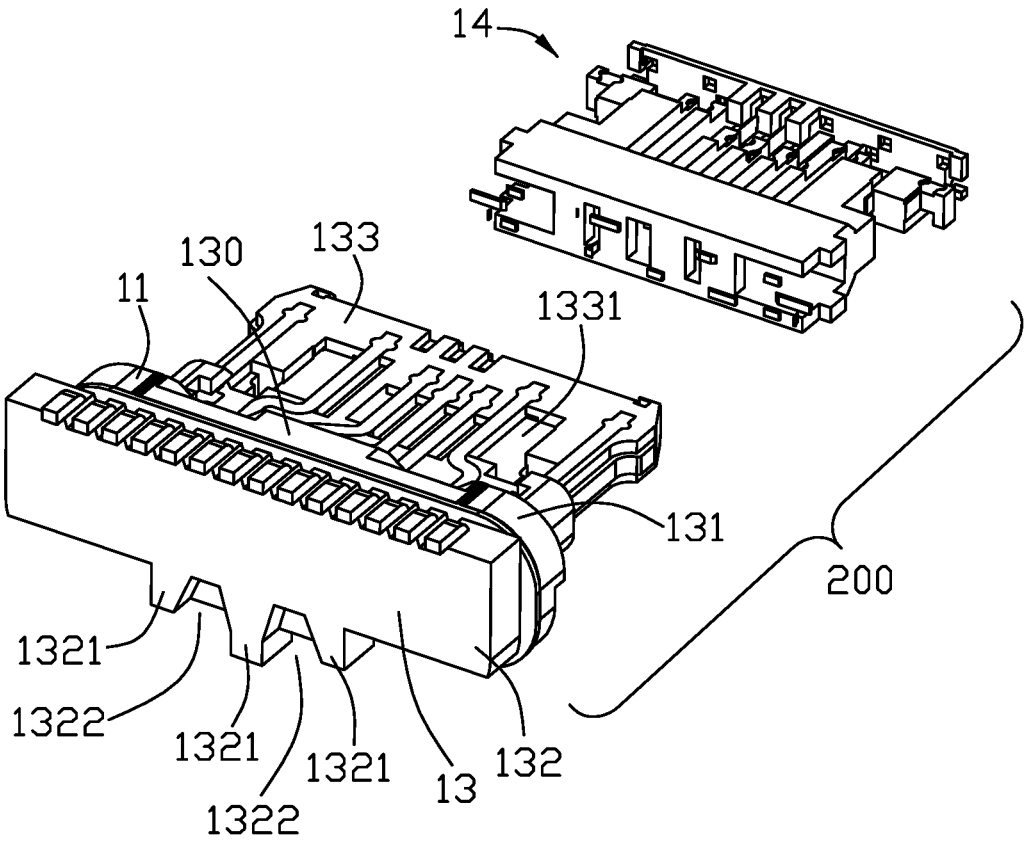
FIG. 8 is a view similar to FIG. 7 but from a different perspective.

Referring specifically to FIGS. 3-4, the plurality of contacts 2 include an upper row of contacts 21, i.e., the upper contacts, and a lower row of contacts 22, i.e., the lower contacts, so designed and arranged in number and in function that the electrical connector 1 may support mating of a complementary plug connector in either of two orientations.

The upper row of contacts 21 include two outermost ground contacts 211, two power contacts 212 next to the two ground contacts 211, and plural signal contacts. Each of the contacts 21 has a contacting portion 213, a tail portion 215, and an intermediate portion 214 between the contacting portion 213 and the tail portion 215. The lower row of contacts 22 include two outermost ground contacts 221, two power contacts 222 next to the two ground contacts 221, and plural signal contacts. Each of the contacts 22 has a contacting portion 223, a tail portion 225, and an intermediate portion 224 between the contacting portion 223 and the tail portion 225.

The metallic element 3 is arranged as a pair of separate planar structures each including initially a bridge 33 and an outer first/grounding plate 31 and an inner second/power plate 32 connected to each other by the bridge 33. Provision of the bridge 33 eases manufacturing of the separated first and second plates.

Figure 9:
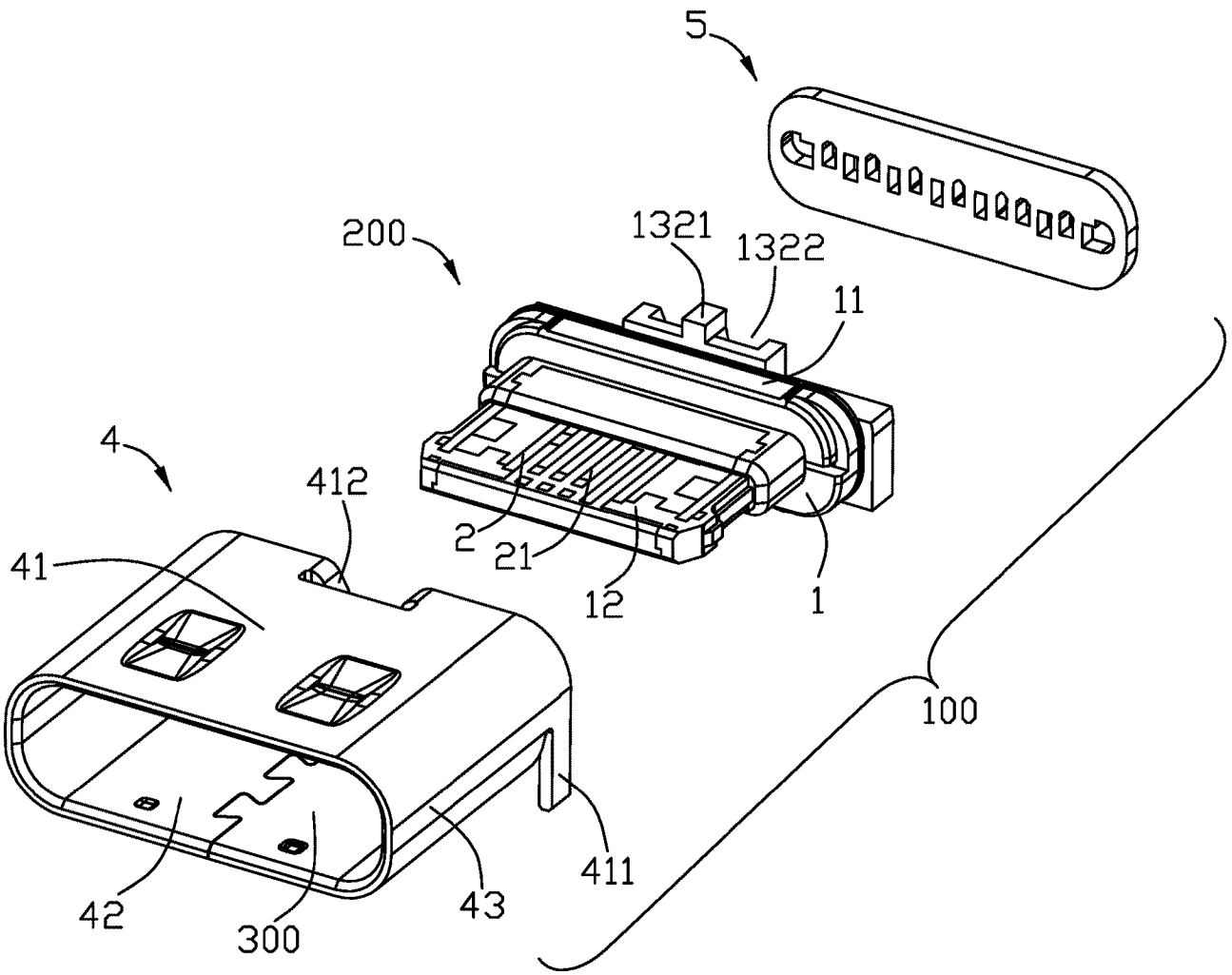
FIG. 9 is an exploded view of the electrical connector.
Figure 10:
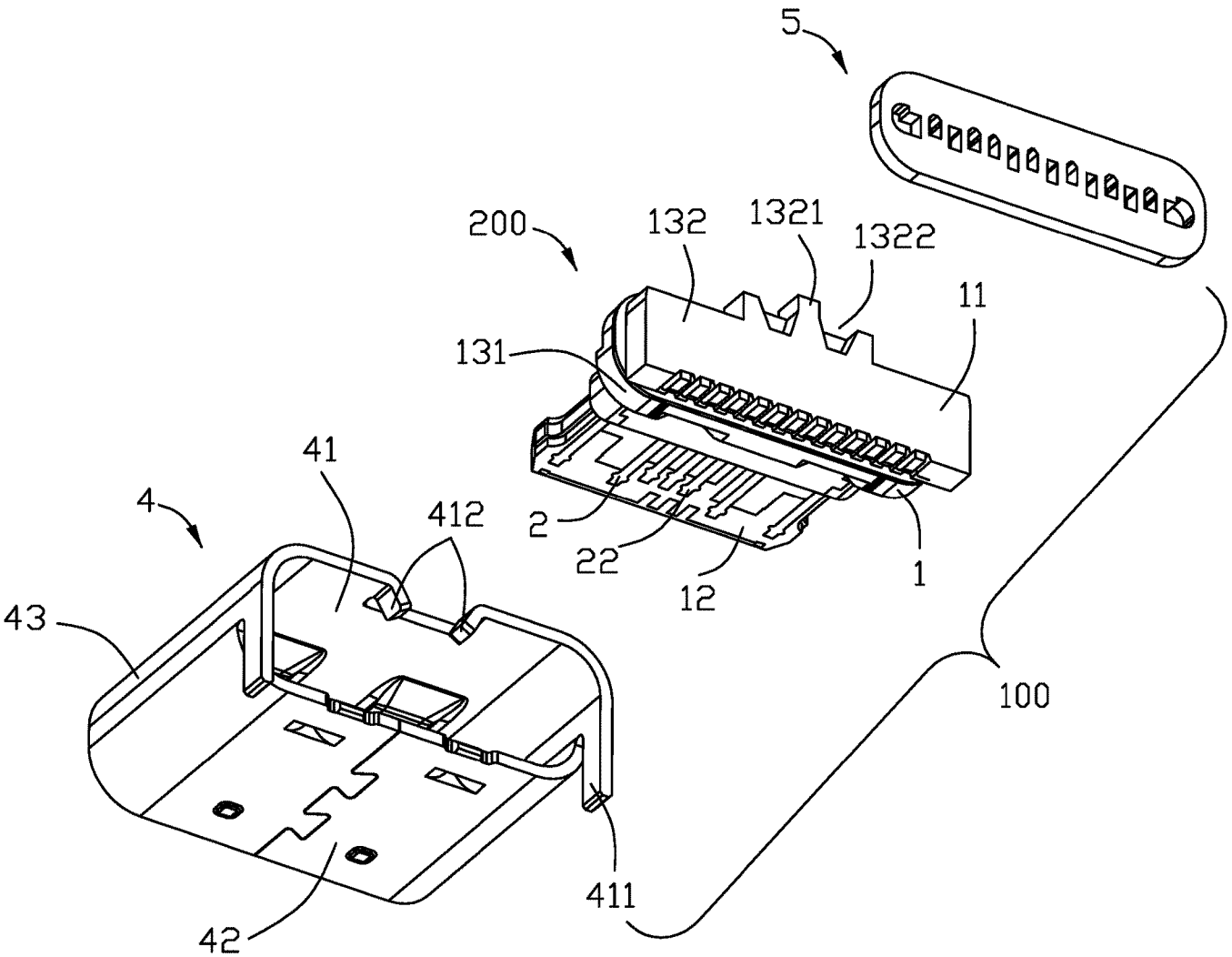
FIG. 10 is another exploded view of the electrical connector.
Figure 11:
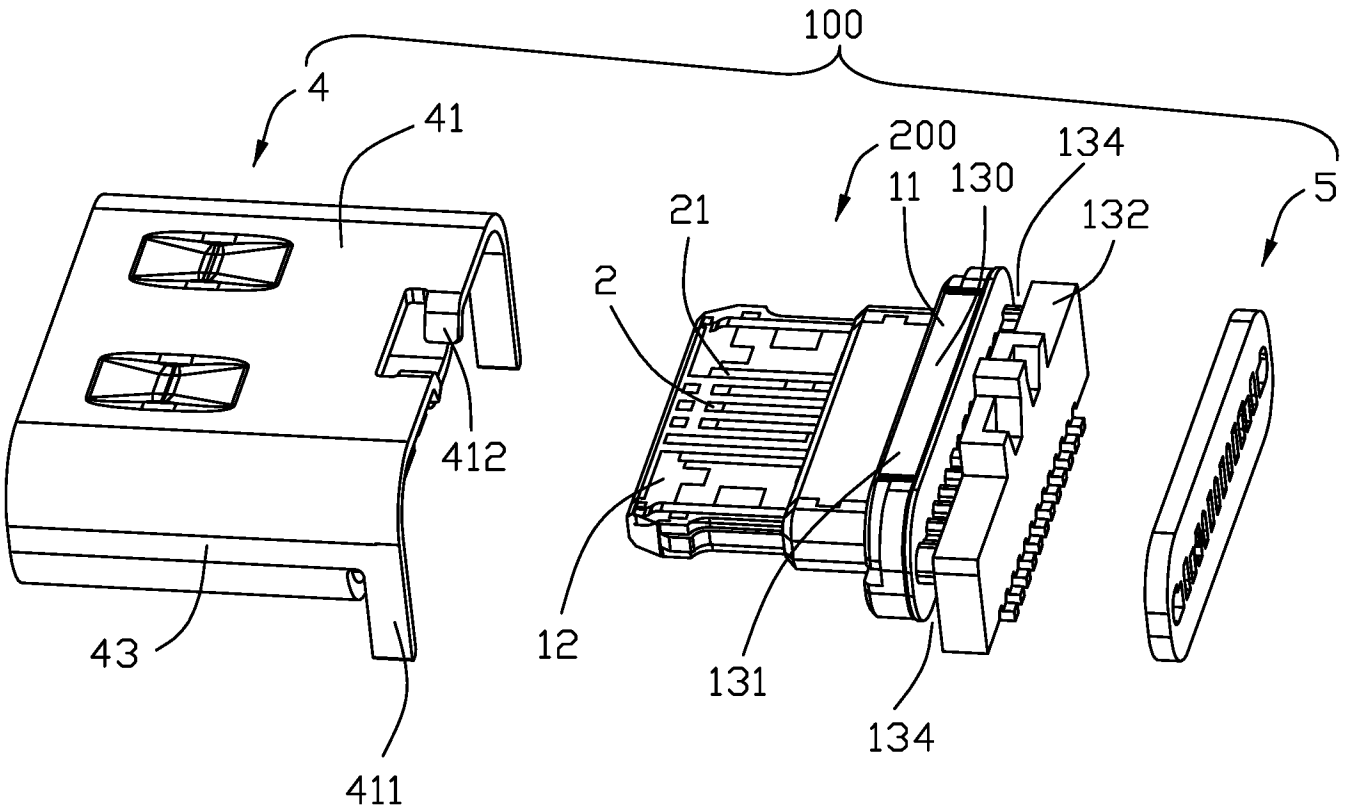
FIG. 11 is a further exploded view of the electrical connector.
Figure 12:
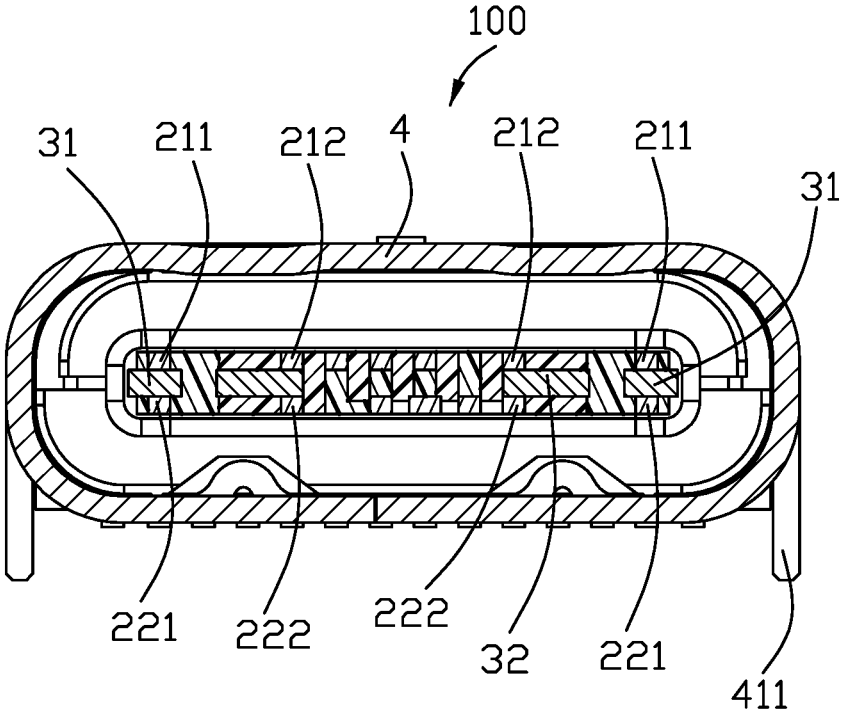
FIG. 12 is a cross-sectional view of the electrical connector taken along line A-A in FIG. 1.
Figure 13:
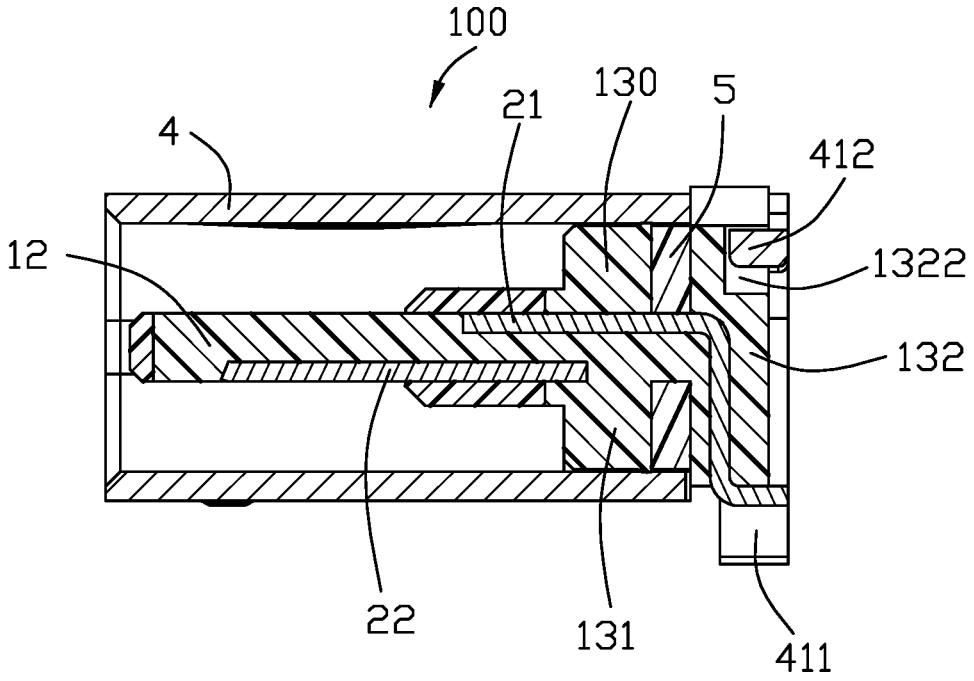
FIG. 13 is a cross-sectional view of the electrical connector taken along line B-B in FIG. 1.

Referring specifically to FIGS. 9-11, the shielding shell 4 has a top wall, a bottom wall 42, and a pair of side walls 43 surrounding a receiving space 300. The top wall 41 has a pair of fixing legs 411 and a pair of fixing tabs 412.

Referring to FIGS. 1-13, a method of making the electrical connector 100 essentially comprises the steps of: insert molding the first insulator 13 with the upper and lower rows of contacts 21 and 22 and the metallic element 3 that is arranged between the upper row of contacts 21 and the lower row of contacts 22 while leaving the void space 1331 to expose the bridge 33 of the metallic element 3; cutting the bridge 33 of the metallic element 3 through the void space 1331 to form the first plate 31 and the second plate 32 that are separated from each other; and insert molding the second insulator 14 to the insert molded contacts 2 and metallic element 3, thereby filling up the void space 1331. The above step of insert molding the first insulator may comprise contacting the ground contact 211 of the upper row and the ground contact 221 of the lower row with two opposite surfaces of the first plate 31 of the metallic element 3 before applying the first insulator 13.

The step of insert molding the first insulator may further comprise contacting the power contact 212 in the upper row and the power contact 222 in the lower row with two opposite surfaces of the second plate 32 of the metallic element 3 before applying the first insulator 13. It should be noted that the upper row of contacts 21 are originally equipped with corresponding bridges between every adjacent two contacts and the lower row of contacts are as well before applying the first insulator 13, similar to what is disclosed in the U.S. Patent Application Publication No. 20160359274 having the same applicant with the invention. Anyhow, in the instant application, after applying the first insulator 13 and before applying the second insulator 14, not only the bridges between the corresponding contacts but also those between the metallic plates should be removed, compared with only the bridges between the corresponding contacts being removed in the aforementioned application publication. Notably, the grounding plate intimately sandwiched between upper grounding contact and lower contact grounding contact is disclosed before in the corresponding patents of the same applicant with the instant application; anyhow in the instant invention the power plate intimately sandwiched between the upper power contact and the lower power contact and made via the same insert-molding procedure has its own novel features compared with the traditional connectors.

In mounting the contact module 200 to the receiving space 300 of the shielding shell 4, a gap 601 is formed between an inner surface of the shielding shell top wall 41 and an outer surface of the base part rear portion 132. The rear sealing element 5 is formed in place by applying and solidifying suitable material through the gap 601.

What is claimed is:

1. An electrical connector comprising:

a plurality of upper contacts and a plurality of lower contacts opposite to each other in a vertical direction, said upper contacts including corresponding upper power contacts and upper grounding contacts;

said lower contacts including corresponding lower power contacts and lower grounding contacts;

a metallic power plate and a metallic grounding plate spaced from each other in a transverse direction perpendicular to said vertical direction; and the upper contacts, the lower contacts, the power plate and the grounding plate all integrally formed within an insulator via insert-molding; wherein in the vertical direction, the power plate is intimately sandwiched between the upper power contact and the lower power contact, and the grounding plate is intimately sandwiched between the upper grounding contact and the lower grounding contact; wherein said power plate and said grounding plate are derived from same sheet metal, wherein said power plate and said grounding plate are originally linked with a bridge which extends in a transverse direction perpendicular to said vertical direction and is removed by cutting before completing said insulator so as to leave a space, which is originally occupied by the bridge, filled with a material of the insulator, and wherein said insulator includes a first insulator and a second insulator wherein the first insulator is applied to the upper contacts, the lower contacts, the power plate and the grounding plate before removing the bridge while the second insulator is applied to the upper contacts, the lower contacts, the power plate and the grounding plate after the bridge is removed so as to fill the space.

2. An electrical connector comprising: a plurality of upper contacts and a plurality of lower contacts opposite to each other in a vertical direction, said upper contacts including corresponding upper power contacts and upper grounding contacts;

said lower contacts including corresponding lower power contacts and lower grounding contacts;

a metallic power plate and a metallic grounding plate spaced from each other in a transverse direction perpendicular to said vertical direction; and the upper contacts, the lower contacts, the power plate and the grounding plate all integrally formed within an insulator via insert-molding;

wherein in the vertical direction, the power plate is intimately sandwiched between the upper power contact and the lower power contact, and the grounding plate is intimately sandwiched between the upper grounding contact and the lower grounding contact;

wherein said power plate and said grounding plate are derived from same sheet metal;

wherein said power plate and said grounding plate are originally linked with a bridge which extends in a transverse direction perpendicular to said vertical direction and is removed by cutting before completing said insulator so as to leave a space, which is originally occupied by the bridge, filled with material of the insulator;

wherein in the vertical direction, the power plate is thicker than both the upper power contact and the lower power contact, and the grounding plate is thicker than both the upper grounding contact and the lower grounding contact; in the transverse direction, the power plate is wider than both the upper power contact and the lower power contact, and the grounding plate is wider than both the upper grounding contact and the lower grounding contact.

* * * * *